United States Patent [19]

Bard et al.

[11] Patent Number: 4,868,899

[45] Date of Patent: Sep. 19, 1989

[54] SPACE HEATING ELEMENT COMPRISING A CERAMIC SHAPED BODY PROVIDED WITH AN ELECTRICALLY RESISTIVE COATING, IN PARTICULAR IN THE FORM OF A CERAMIC TILE

[75] Inventors: Martin Bard, Amberg; Gottfried Cremer, Cologne, both of Fed. Rep. of Germany

[73] Assignee: Buchtal Gesellschaft mit beschrankter Haftung, Fed. Rep. of Germany

[21] Appl. No.: 156,181

[22] Filed: Feb. 16, 1988

[30] Foreign Application Priority Data

Feb. 17, 1987 [DE] Fed. Rep. of Germany ..... 3705028
Mar. 31, 1987 [DE] Fed. Rep. of Germany ..... 3710626

[51] Int. Cl.[4] ..... H05B 3/16
[52] U.S. Cl. ..... 219/543
[58] Field of Search ..... 219/543, 553, 216

[56] References Cited

U.S. PATENT DOCUMENTS 4,469,936 9/1984 Hunter ..... 219/543
4,544,828 10/1985 Shigenobu et al. ..... 219/553 X

*Primary Examiner*—E. A. Goldberg
*Assistant Examiner*—M. M. Lateef
*Attorney, Agent, or Firm*—Remy J. VanOphem

[57] ABSTRACT

A space heating element having a ceramic body, an electrically conductive ceramic glaze provided on the side of the ceramic shaped body opposite the visible side, and a nonconductive ceramic glaze provided over the electrically conductive glaze. The electrically resistive glaze has nonmetallic electrically conductive particles embedded in a carrier substance. The nonconductive glaze has the same carrier substance as the electrically conductive glaze but has kaolin particles embedded therein in place of the nonmetallic electrically conductive particles. The ceramic body, electrically resistive glaze and nonconductive ceramic glaze are heated to a temperature below the quartz transition temperature.

10 Claims, 1 Drawing Sheet

FIG. 1
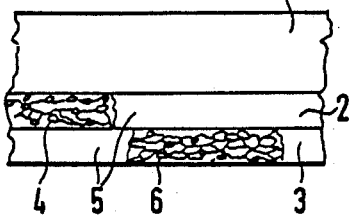
FIG. 2 PRIOR ART
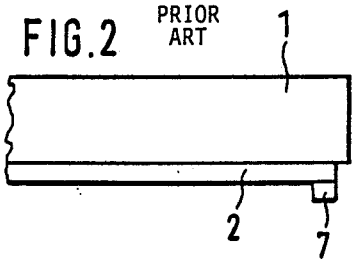
FIG. 4
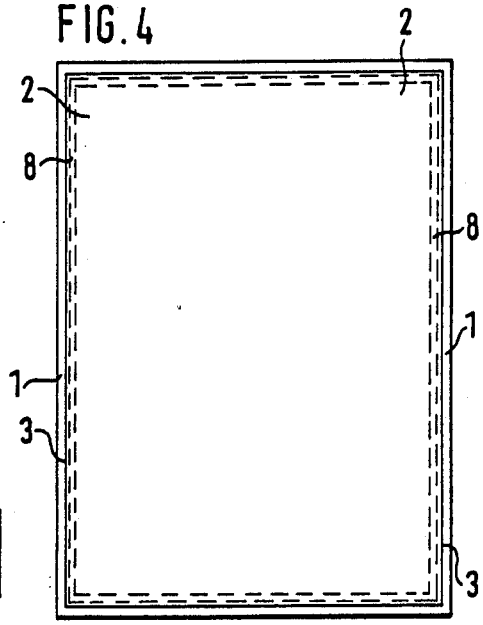
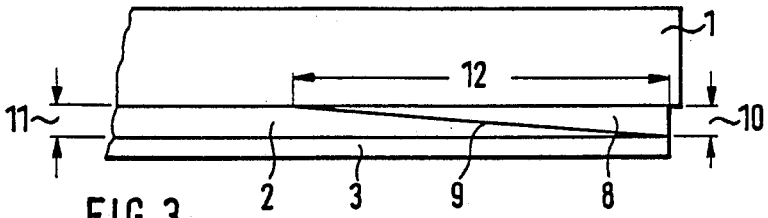
FIG. 3

SPACE HEATING ELEMENT COMPRISING A CERAMIC SHAPED BODY PROVIDED WITH AN ELECTRICALLY RESISTIVE COATING, IN PARTICULAR IN THE FORM OF A CERAMIC TILE

BACKGROUND OF THE INVENTION

1. Field of the Invention

The invention is related to the field of decorative ceramic tiles and in particular to ceramic tiles having a heating element formed on the side opposite the side that is visible when the ceramic tile is cemented to a floor, wall or ceiling.

2. Description of the Prior Art

EU-A-0 158 091 discloses a space heating element composed of a ceramic shaped body provided on the side facing away from its visible side with a heating conductor extending across its surface in the form of an electrically resistive coating consisting of an electrically conductive ceramic glaze. The electrically resistive coating is a resistive layer made of a material in which nonmetallic electrically conductive particles which have a large specific area and do not substantially alter their electrical conductivity at higher temperatures are embedded in an electrically nonconductive or poorly conductive carrier substance. The electrically resistive coating is applied in such a way that the resistive coating has even electrical and thermal conductivity. A special form of such a space heating element is, for example, a large-area wall, floor or ceiling tile.

Under unfavorable conditions, tiles having an electrically resistive coating consisting of an electrically conductive ceramic resistance glaze may suddenly come off. This makes it problematic to attach such tiles to ceilings or even walls by means of adhesive because additional means of attachment such as clamps or hooks would be required, however this is often impossible or at least undesirable.

According to EU-A-0 158 091, the electrically resistive coating is contacted in particular by contacting elements disposed symmetrically on the electrically resistive layer. However, it has turned out that such elements provided on the heating layer tend to come off and also fall to ensure a sufficiently even passage of electricity across a surface.

The problem of insufficient adhesion also occurs, surprisingly enough, between the conductive resistive layer and an insulating layer by means of which the lining element is attached to the attachment base.

There is up to now apparently no insulating material, in particular organic insulating material, which enters into a permanent and reliable bond with the conductive resistive layer.

The invention is based on the problem of designing the electrically conductive resistive coating of the lining element in such a way as to prevent it from coming off either the attachment base directly or an insulating layer thereabove, and also so as to bring about an improvement in the heating properties of the space heating element.

The problems discussed above are solved according to the invention by covering the resistive layer present in the form of an electrically conductive resistance glaze by a layer of nonconductive or poorly conductive ceramic glaze with a carrier substance having the same composition as the resistance glaze but with incorporated kaolin particles, and heating the formation consisting of the ceramic shaped body, the electrically conductive ceramic glaze and the ceramic cover layer to a temperature below the quartz transition point (<750° C.), thereby fusing the resistive layer and the cover layer into the ceramic lining element.

Surprisingly, every organic insulating coating adheres without any problem to a lining element coating in this way.

Another surprising effect of the proposed solution is that the electrical resistance of the covered resistive layer, i.e. the heating layer, is considerably reduced. This is due to the fact that if there is a suitably selected surplus of kaolin particles relative to the glass parts of the carrier substance, glass parts come out of the resistance glaze (heating layer) during firing of the overall formation and are bound into the cover layer. This reduces the insulating glass substance in the resistance glaze which has an adverse effect on the electrical conduction of the resistance glaze, thereby reducing the electrical resistance of the resistance glaze, i.e. the heating layer. One thus obtains an improvement in the heating properties of the space heating element due to the embedding of kaolin particles in the cover layer.

For example, with 30% by weight of kaolin one observed a resistance reduction to 50% compared to that of the same formation without the addition of a cover layer.

This phenomenon has been utilized according to the invention in such a way that the amount of kaolin particles of the cover layer is selected so as to obtain a certain change of conductivity which in turn allows for a distinct reduction in the amount of electrically conductive particles in the heating layer, without altering the originally desired electrical resistance of the heating layer, i.e. without a cover.

With respect to the electrical contacting elements provided on the heating layer, an even passage of electricity across the surface is achieved by contacting the electrical heating layer in such a way that the contact elements or contact layer is applied directly to the ceramic shaped body, this layer growing in ramp-like fashion toward the outer edge of the ceramic shaped body with the ramp height dimensioned in accordance with the thickness of the heating layer and the ramp width more than fifty times this thickness. In one embodiment the heating layer thickness was 120$\mu$ and the width of the contact layer 15 mm. This measure also reduces the tendency of the contact elements or contact layer to come off.

A further advantage of this proposed solution is based on the application of the contact layer directly to the back of the ceramic shaped body as the first procedural step, which is followed by the application of the electrical heating layer as the second step. The third step is to apply the cover layer and in a fourth step the entire formation is subjected to a firing or heating process.

BRIEF DESCRIPTION OF THE DRAWINGS

In the following, embodiments of the invention shall be described schematically with reference to the drawing, in which FIG. 1 shows a schematic partial cross-section of a space heating element;

FIG. 2 shows a partial cross-section of a space heating element according to EU-A-0 158 091;

FIG. 3 shows a partial cross-section of a further embodiment of the invention; and FIG. 4 shows a top view of a space heating element according to FIG. 3.

The space heating element shown in FIG. 1 includes a ceramic shaped body 1 provided on its side facing away from the visible side with an electrically resistive coating 2 which forms the heating layer, and also with a cover layer 3. The electrically resistive coating 2 is composed of a carrier substance 5 and conductive particles 4 embedded in the carrier substance. The cover layer 3 is composed of the same carrier substance 5 and kaolin particles 6 embedded therein.

FIG. 2 shows a space heating element as described in EU-A-0 158 091 which is constructed of a ceramic shaped body 1, an electrically resistive coating 2 and a contact element 7.

FIG. 3 shows an embodiment of the inventive space heating element consisting of an electrically resistive coating 2, a cover layer 3 and a contact element 8. The contact element 8 increase in ramp-like fashion at 9 toward the outer edge of the ceramic shaped body. The contact element, which may be formed by a contact layer, has a substantially triangular cross-section in the embodiment shown. Maximum ramp height 10 corresponds to layer thickness 11 of the electrically resistive coating 2. Width 12 of the contact element is more than fifty times thickness 11 of electrically resistive coating 2. FIG. 4 shows that the contact element is formed on the two opposing longitudinal sides of the space heating element. The space heating element is expediently designed as a largearea wall, floor or ceiling tile which, in particular as a square tile, has side dimensions of 60×60 cm.

The above constitutes a detailed description of the best mode contemplated for carrying out the present invention. It will be apparent to those skilled in the art that variations and modifications may be made from the above described embodiments without departing from the spirit of the present invention. Such variations and modifications are included within the intended scope of the claims appended hereto.

What is claimed is:

1. A space heating element of the type having a ceramic tile body having a visible side and a side facing away from its visible side, said ceramic tile body having an electrically conductive ceramic glaze provided on the side facing away from its visible side, said electrically conductive ceramic glaze consisting of a nonconductive carrier and nonmetallic electrically conductive particles embedded therein, an improvement characterized by the electrically conductive ceramic glaze being covered with a nonconductive ceramic glaze, said nonconductive ceramic glaze having the same nonconductive carrier as said electrically conductive ceramic glaze and a predetermined amount of kaolin particles incorporated in the nonconductive carrier.

2. A space heating element as in claim 1 wherein the predetermined amount of incorporated kaolin particles is selected so as to effect a distinct reduction in the electrical resistance of the conductive ceramic glaze.

3. A space heating element as in claim 1 wherein the amount of incorporated kaolin particles is selected in such a way that, due to the resulting reduction in the original electrical resistance of the conductive ceramic glaze, the amount of nonmetallic electrically conductive particles embedded in the conductive ceramic glaze can be distinctly reduced in order to obtain the originally desired electrical resistance.

4. A space heating element as in claim 1 further having at least one electrical contact element electrically connected to the conductive ceramic glaze, said contact element being applied directly to the ceramic body, the thickness of the contact element increases in ramp-like fashion toward the outer edge of the ceramic shaped body.

5. A space heating element as in claim 4, characterized in that the maximum ramp height corresponds to the thickness of the conductive ceramic glaze and the ramp width is more than fifty times this thickness.

6. A space heating element as in claim 4 wherein the contact element has an substantially triangular cross-section.

7. A space heating element as in claim 5 wherein the contact element has an substantially triangular cross-section.

8. A space heating element as in claim 4 wherein the contact element is formed by a contact layer.

9. A space heating element as in claim 6 wherein the contact element is formed by a contact layer.

10. A space heating element as in claim 5 wherein the contact element is formed by a contact layer.

* * * * *

UNITED STATES PATENT AND TRADEMARK OFFICE

CERTIFICATE OF CORRECTION

PATENT NO. : 4,868,899

DATED : September 19, 1989

INVENTOR(S) : Bard et al

It is certified that error appears in the above-identified patent and that said Letters Patent is hereby corrected as shown below:

Column 1, line 45, delete "fall" and insert ---- fail ----.

Column 1, after present line 61, insert as a subheading ---- SUMMARY OF THE INVENTION ----.

Column 3, after present line 2, insert as a subheading ---- DETAILED DESCRIPTION OF THE PREFERRED EMBODIMENT ----.

Column 3, line 19, delete "increase" and insert ---- increases ----.

Column 3, line 26, after "times" insert ---- the ----, same line, after "of" insert ---- the ----.

Column 3, line 30, delete "largearea" and insert ---- large-area ----.

UNITED STATES PATENT AND TRADEMARK OFFICE

CERTIFICATE OF CORRECTION

PATENT NO. : 4,868,899

DATED : September 19, 1989

INVENTOR(S) : Bard et al

It is certified that error appears in the above-identified patent and that said Letters Patent is hereby corrected as shown below:

Column 4, line 25, after "ceramic" insert ---- tile ----.

Column 4, line 35, delete "an" and insert ---- a ----.

Column 4, line 38, delete "an" and insert ---- a ----.

Signed and Sealed this

Twenty-third Day of July, 1991

*Attest:*

*Attesting Officer*

HARRY F. MANBECK, JR.

*Commissioner of Patents and Trademarks*